US008052438B1

(12) United States Patent
Hung

(10) Patent No.: US 8,052,438 B1
(45) Date of Patent: Nov. 8, 2011

(54) CONNECTOR MODULE

(75) Inventor: Hsu-Tsung Hung, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 12/980,294

(22) Filed: Dec. 28, 2010

(30) Foreign Application Priority Data

Nov. 3, 2010 (TW) ..... 99221290 U

(51) Int. Cl.
*H01R 13/44* (2006.01)

(52) U.S. Cl. ..... 439/131

(58) Field of Classification Search ..... 439/131, 439/528

See application file for complete search history.

(56) References Cited

U.S. PATENT DOCUMENTS 5,424,729 A * 6/1995 Kishi et al. ..... 341/23
7,125,265 B2 * 10/2006 Weng ..... 439/131
2009/0239417 A1 * 9/2009 Abrahamsson et al. . 439/607.01

FOREIGN PATENT DOCUMENTS

TW M361127 7/2009
TW M376063 3/2010

* cited by examiner

*Primary Examiner* — Tulsidas C Patel
*Assistant Examiner* — Travis Chambers
(74) *Attorney, Agent, or Firm* — Jianq Chyun IP Office

(57) ABSTRACT

A connector module including a case, a first connector, a second connector, and a switching unit is provided. The first connector disposed in the case has a first connecting portion. The second connector slidably disposed in the case has a second connecting portion. The switching unit is connected between the second connector and the case, and drives the second connector to move along an axis between a first position and a second position. When the second connector is located at the first position, only the first connecting portion is exposed from the case. When the second connector is located at the second position, the first and the second connecting portions are close to each other and exposed from the case.

10 Claims, 4 Drawing Sheets

CONNECTOR MODULE

CROSS-REFERENCE TO RELATED APPLICATION

This application claims the priority benefit of Taiwan application serial no. 99221290, filed on Nov. 3, 2010. The entirety of the above-mentioned patent application is hereby incorporated by reference herein and made a part of this specification.

BACKGROUND OF THE INVENTION

1. Field of the Invention

The present invention generally relates to a connector module, in particular, to a connector module, capable of being switched to different modes.

2. Description of Related Art

Universal Serial Bus 3.0 (USB 3.0) is a signal transmission specification standard evolved from USB 2.0, in which a transmission rate of the USB 3.0 can reach 5G bps, but a transmission rate of a traditional USB 2.0 is only 480M bps. Currently, it is sure that a USB 3.0 electrical connector is compatible with a USB 2.0 electrical connector. That is to say, the USB 3.0 adopts the electrical connector structure being the same as that of the USB 2.0, and several pins are added to provide USB 3.0 functions. Therefore, based on the USB 2.0 electrical connector structure, a USB 3.0 electrical connector structure is required to satisfy demands.

SUMMARY OF THE INVENTION

Accordingly, the present invention is directed to a connector module, having connecting portions capable of being switched into different modes.

The present invention provides a connector module, which includes a case, a first connector, a second connector, and a switching unit. The first connector is disposed in the case, and has a first connecting portion. The second connector is slidably disposed in the case, and has a second connecting portion. The switching unit is connected between the second connector and the case. The switching unit drives the second connector to move along a first axis between a first position and a second position. When the second connector is located at the first position, only the first connecting portion is exposed from the case. When the second connector is located at the second position, the first connecting portion and the second connecting portion are close to each other and are exposed from the case.

In an embodiment of the present invention, the first connecting portion is a micro USB 2.0 connector.

In an embodiment of the present invention, the first connecting portion and second connecting portion being close to each other form a micro USB 3.0 connector.

In an embodiment of the present invention, the switching unit includes an elastic tenon and a pair of hooks. The elastic tenon is disposed at the second connector. The hook is disposed at the case and at a moving path of the elastic tenon. When the second connector is located at the first position, the elastic tenon is snapped with one of the hooks. When the second connector is located at the second position, the elastic tenon is snapped with the other one of the hooks.

In an embodiment of the present invention, the elastic tenon has a base portion, an elastic arm, and a press portion. The base portion is disposed in a slot of the second connector. Two ends of the elastic arm are connected to the base portion.

The press portion is connected to a central part of the elastic arm, and is exposed from the case.

In an embodiment of the present invention, the press portion is pressed along a second axis, so that the elastic tenon is ejected from the hooks, and the second connector slides in the case, and the second axis is perpendicular to the first axis.

In an embodiment of the present invention, the elastic tenon further has a pair of snapping portions, located at the elastic arm and at two opposite sides of the press portion. When the second connector is located at the first position or the second position, one of the snapping portions is snapped with one of the hooks. When the press portion is pressed along the second axis, the snapping portion is ejected from the hook.

In an embodiment of the present invention, the case further has a display window, and the second connector has two display symbols disposed along the first axis. When the second connector is located at the first position, one of the display symbols is exposed from the case through the display window. When the second connector is located at the second position, the other one of the display symbols is exposed from the case through the display window.

In view of the above, in the embodiments of the present invention, the connector module is slidably disposed in the case through the second connector, so that a user can switch the connector module among different modes through the switching unit, so the connector module has a preferable application scope.

In order to make the aforementioned features and advantages of the present invention more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
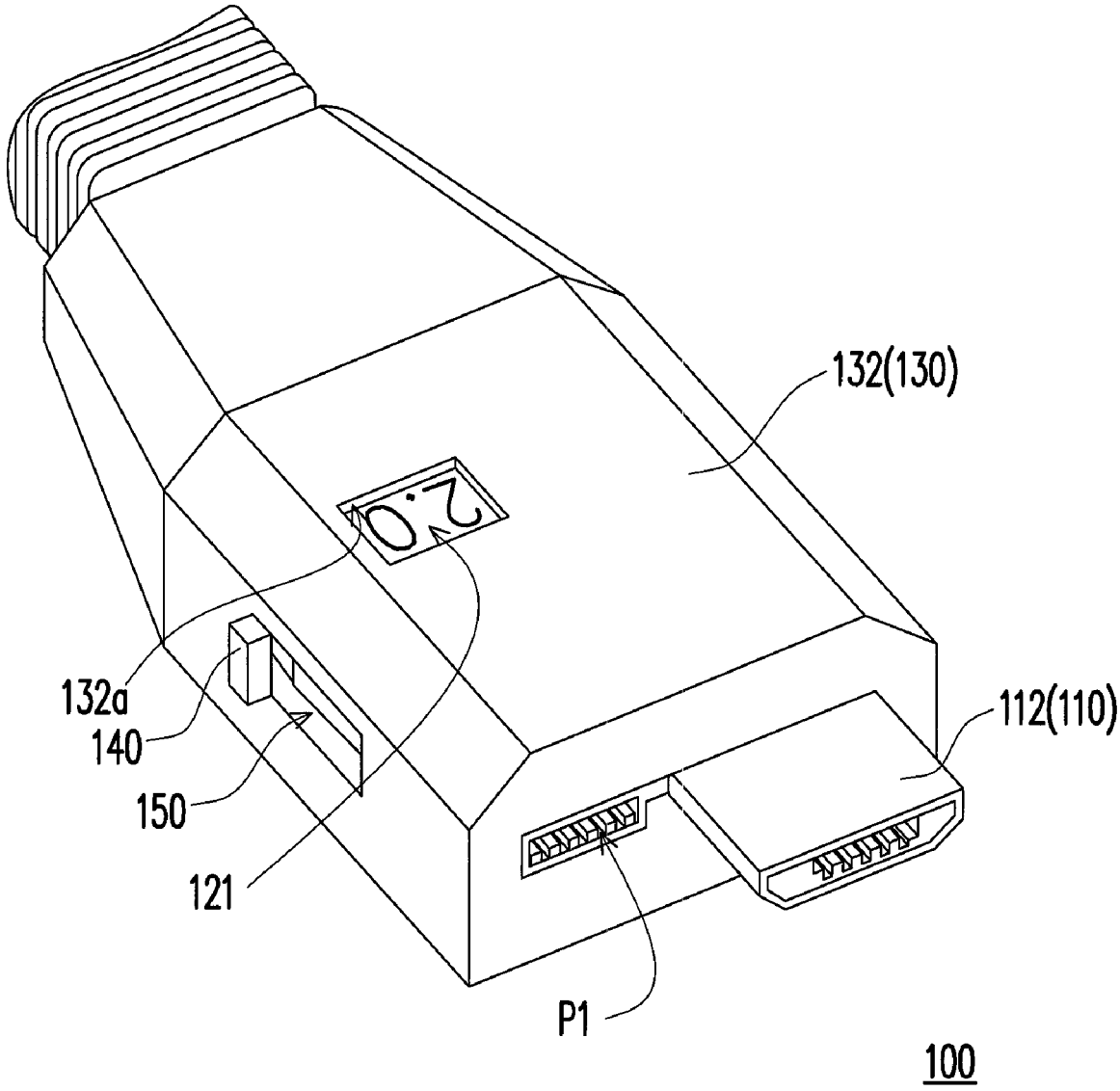
FIG. 1 and FIG. 2 are schematic views of a connector module in different states according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
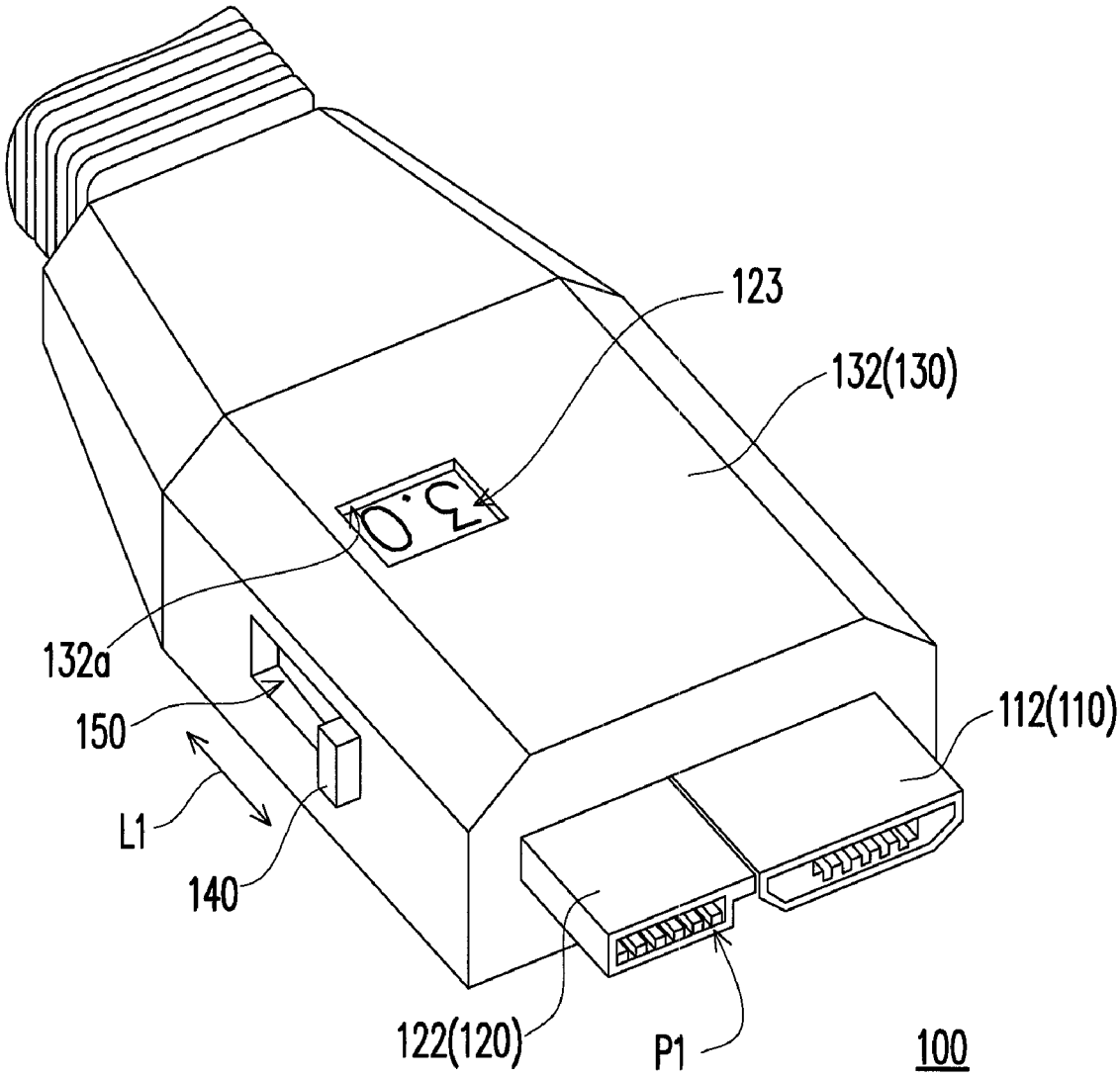
Figure 3:
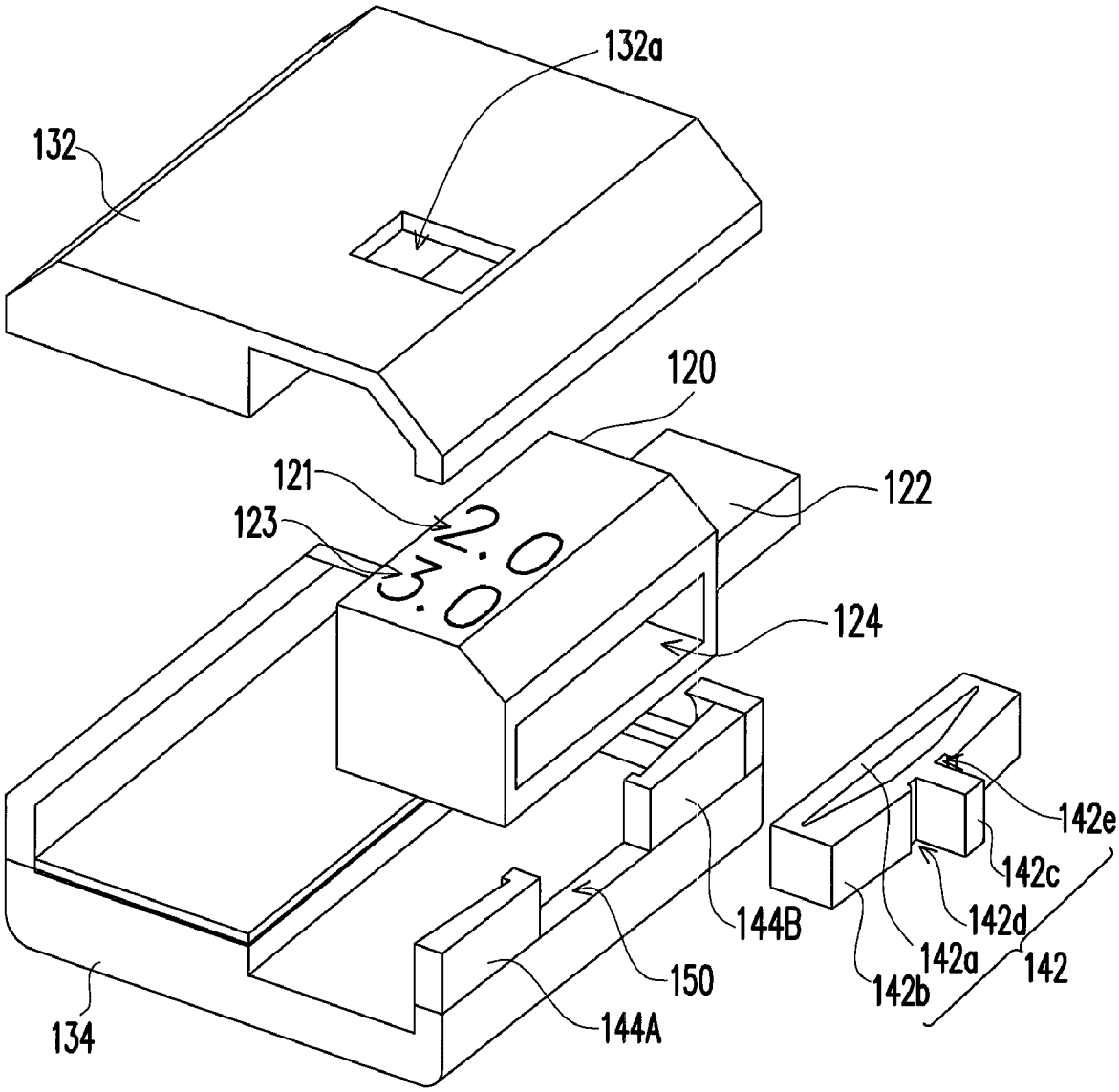
FIG. 3 is an exploded view of the connector module of FIG. 1 and FIG. 2.

FIG. 1 and FIG. 2 are schematic views of a connector module in different states according to an embodiment of the present invention. FIG. 3 is an exploded view of the connector module of FIG. 1 and FIG. 2. Referring to FIG. 1 to FIG. 3, in this embodiment, the connector module 100 includes a first connector 110, a second connector 120, a case 130, and a switching unit 140. The first connector 110 is fixed in the case 130, and the first connector 110 has a first connecting portion 112 exposed from a front face of the case 130. The second connector 120 is slidably disposed in the case 130, and the second connector 120 has a second connecting portion 122 extending from the front face of the case. The switching unit 140 is connected between the second connector 120 and the case 130.

In this embodiment, the switching unit 140 drives the second connector 120 to move along a first axis L1 between a first position P1 (as shown in FIG. 1) and a second position P2 (as shown in FIG. 2). When the second connector 120 is located at the first position P1, the second connecting portion 122 of the second connector 120 is located in the case 130. That is to say, here only the first connecting portion 112 of the first connector 110 is exposed from the case 130, thereby resulting in a state of the connector module 100 shown in FIG. 1. Moreover, when the switching unit 140 drives the second connector 120 to move to the second position P2, the second connecting portion 122 moves out from the case 130 and is exposed from the case 130. That is to say, here both the first connecting portion 112 and the second connecting portion 122 are exposed from the case 130, thereby resulting in a state of the connector module 100 in FIG. 2, at this time the front end face of the first connecting portion 122 and the front end of the second connecting portion 130 are in the same vertical plane.

In view of the above, the switching unit 140 drives the second connector 120 being movable in the case 130, so the connector module 100 according to the present invention can be switched between two different modes, so that the connector module 100 may be applicable to various connector modes, thereby enlarging the application scope thereof.

Furthermore, in this embodiment, the first connecting portion 112 of the first connector 110 is a connector satisfying micro USB 2.0, and the first connecting portion 112 and second connecting portion 122 being close to each other form a micro USB 3.0 connector. Therefore, through the connector module 100 according to the present invention, a user can successfully connect two connectors of different specifications without using any additional adapter. But this embodiment is not limited thereto. All cases, in which the switching unit 140 can be used to drive the connector 110 or the connector 120 in the connector module 100 for permutation and combination to put the connector module 100 into various modes, are applicable to this embodiment.

In this embodiment, the switching unit 140 includes an elastic tenon 142 and a pair of hooks 144A and 144B. The elastic tenon 142 is disposed at the second connector 120. The hooks 144A and 144B are disposed at the case 130 and at a moving path of the elastic tenon 142. Specifically, the elastic tenon 142 has a base portion 142*a*, an elastic arm 142*b*, and a press portion 142*c*. The base portion 142*a* is disposed in a slot 124 of the second connector 120. Two ends of the elastic arm 142*b* are connected to the base portion 142*a*, and the press portion 142*c* is connected to a central part of the elastic arm 142*b*. Therefore, the press portion 142*c* can be pressed or released along a second axis L2.

Additionally, the case 130 includes an upper case 132 and a lower case 134, which are assembled together. The lower case 134 is used to support the first connector 110 and the second connector 120. After being assembled, the upper case 132 and the lower case 134 form a space for receiving the first connector 110 and the second connector 120. In addition, after the upper case 132 and the lower case 134 are assembled, the hooks 144A and 144B are disposed at one side of the upper case 132 and lower case 134, and face the inside of the case 130. In addition, a switching opening 150 is formed between the upper case 132 and the lower case 134, and the pair of hooks 144A and 144B, so that the press portion 142*c* of the elastic tenon 142 is exposed from the inside of the case 130 through the switching opening 150 to the outside of the case 130.

It should be noted that, the elastic tenon 142 further has a pair of snapping portions 142*d* and 142*e*, for example, a pair of notches corresponding to the pair of hooks 144A and 144B. The snapping portions 142*d* and 142*e* are disposed at the elastic arm 142*b* of the elastic tenon 142, and are located at two opposite sides of the press portion 142*c*. Furthermore, through the structural design of the elastic arm 142*b*, the user can press or release the press portion 142*c* of the elastic tenon 142 along the second axis L2.

Figure 4A:
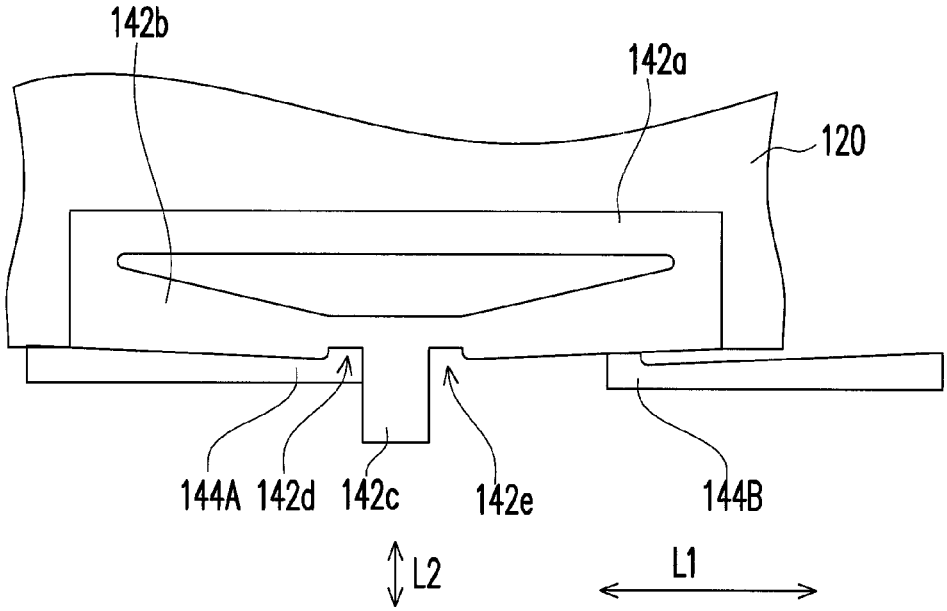
FIG. 4A and FIG. 4B are partial top views at an elastic tenon of the connector module of FIG. 1 or FIG. 2.
Figure 4B:
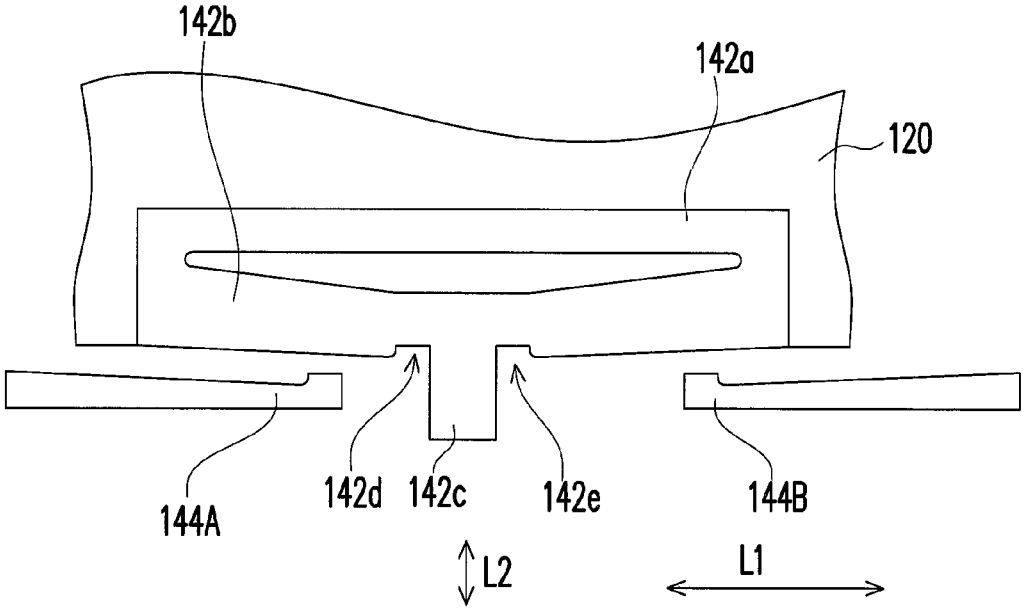

FIG. 4A and FIG. 4B are partial top views at the elastic tenon of the connector module from FIG. 1 and FIG. 2. Some components are omitted herein, so as to make a relation between the elastic tenon and the hooks easily distinguishable. In this embodiment, the second axis L2 is substantially perpendicular to the first axis L1 along which the second connector 120 slides. Therefore, when the press portion 142*c* is pressed along the second axis L2, the snapping portions 142*d* and 142*e* may be far away from the hooks 144A and 144B to break an interference relation between the second connector 120 and the case 130, so that the second connector 120 can slide along the first axis L1 in the case 130. When the second connector 120 is moved to the first position P1 or the second position P2 and after the press portion 142*c* is released by the user, the snapping portion 142*d* or 142*e* is snapped with the hook 144A or 144B, so that the second connector 120 re-gains the interference relation with the case 130, and the second connector 120 is in a fixed state relative to the case 130.

For example, referring to FIG. 1, FIG. 4A, and FIG. 4B, when the second connector 120 is located at the first position P1, the snapping portion 142*d* of the elastic tenon 142 is snapped with the hook 144A, so that the second connector 120 is in the fixed state relative to the case 130, and the connector module 100 is in the state as shown in FIG. 1. Here, the connector module 100 is a USB 2.0 connector formed by the first connecting portion 112 merely. Additionally, referring to FIG. 2 and FIG. 4, in order to switch the second connector 120 to the second position P2, the user presses the press portion 142*c* to eject the snapping portion 142*d* from the hook 144A, here, the user can drive the second connector 120 to move from the first position P1 to the second position P2 by pressing the press portion 142*c*. Then, after the user releases the press portion 142*c*, the snapping portion 142*e* is snapped with the hook 144B, so that the second connector 120 is in the fixed state again relative to the case 130. Here, the connector module 100 is switched to be a USB 3.0 connector formed by the first connecting portion 112 and the second connecting portion 122.

Referring to FIG. 1 to FIG. 3, in another aspect, in order to enable the user to explicitly recognize a service state of the connector module 100, the upper case 132 further has a display window 132*a*, and the second connector 120 has two display symbols 121 and 123 disposed along the first axis L1. In this embodiment, the display symbols 121 and 123 may be, for example, in the form of words 2.0 and 3.0, so as to display states of the micro USB 2.0 and the micro USB 3.0 to which the connector module 110 is switched. When the second connector 120 is located at the first position P1, the display symbol 121 is exposed from the case 130 through the display window 132*a*. Accordingly, when the second connector 120 is located at the second position P2, the display symbol 123 is exposed from the case 130 through the display window 132*a*.

In view of the above, in the embodiment of the present invention, the connector module is slidably disposed in the case through the second connector, so that the user can switch the connector module among different modes through the switching unit. In addition, with the cooperation of the elastic tenon and the hooks of the switching unit, the user can move and fix the second connector at the first position and the second position, so as to obtain the micro USB 2.0 connector formed by the first connecting portion merely, and the micro USB 3.0 connector formed by the first connecting portion and the second connecting portion, so the connector module has a preferable application scope.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector module comprising:

a case;

a first connector, extending from a front face of the case and comprising a first connecting portion; a second connector, slidably disposed in the case and comprising a second connecting portion; and a switching unit, connected between the second connector and the case, and driving the second connector to move along a first axis between a first position and a second position, wherein when the second connector is located at the first position, only the first connecting portion is extending from the front face of the case to conform to a first connecting standard, and when the second connector is located at the second position, the first connecting portion and the second connecting portion are extending from a front face of the case and are in a same vertical plane to conform to a second connecting standard.

2. The connector module according to claim 1, wherein the first connecting portion is a micro Universal Serial Bus 2.0 connector.

3. The connector module according to claim 1, wherein the first connecting portion and second connecting portion being close to each other form a micro Universal Serial Bus 3.0 connector.

4. The connector module according to claim 1, wherein the case further comprises a display window, the second connector comprises two display symbols disposed along the first axis, when the second connector is located at the first position, one of the display symbols is exposed from the case through the display window, and when the second connector is located at the second position, the other one of the display symbols is exposed from the case through the display window.

5. The connector module according to claim 1, wherein the first connecting portion is suitable to insert into a first specification standard port, and an assembly of the first connecting portion and the second connecting portion is suitable to insert into a second specification standard port.

6. The connector module according to claim 1, wherein the first connecting portion has multiple first terminals arranged in a first path, and the second connecting portion has multiple second terminals arranged in a second path, the first path is the same as the second path.

7. The connector module according to claim 1, wherein the switching unit comprises:

an elastic tenon, disposed at the second connector; and a pair of hooks, disposed at the case and located at a moving path of the elastic tenon, wherein when the second connector is located at the first position, the elastic tenon is snapped with one of the pair of hooks, and when the second connector is located at the second position, the elastic tenon is snapped with the other one of the pair of hooks.

8. The connector module according to claim 7, wherein the elastic tenon comprises a base portion, an elastic arm, and a press portion, the base portion is disposed in a slot of the second connector, two ends of the elastic arm are connected to the base portion, and the press portion is connected to a central part of the elastic arm, and extends from the case.

9. The connector module according to claim 8, wherein the press portion is pressed along a second axis, so that the elastic tenon is ejected from the pair of hooks, and the second connector slides in the case, and the second axis is perpendicular to the first axis.

10. The connector module according to claim 9, wherein the elastic tenon further comprises a pair of snapping portions, located at the elastic arm and at two opposite sides of the press portion, when the second connector is located at the first position or the second position, one of the pair of snapping portions is snapped with one of the pair of hooks, and when the press portion is pressed along the second axis, the pair of snapping portions are ejected from the pair of hooks.

* * * * *